US005211533A

United States Patent [19]

Walker et al.

[11] Patent Number: 5,211,533

[45] Date of Patent: May 18, 1993

[54] FLOW DIVERTER FOR TURBOMACHINERY SEALS

[75] Inventors: Roger C. Walker, Middletown; Christopher C. Glynn, Hamilton, both of Ohio

[73] Assignee: General Electric Company, Cincinnati, Ohio

[21] Appl. No.: 785,377

[22] Filed: Oct. 30, 1991

[51] Int. Cl.[5] ..... F04D 29/58

[52] U.S. Cl. ..... 415/115; 415/914

[58] Field of Search ..... 415/115, 116, 914, 57.3, 415/58.2, 58.7

[56] References Cited

U.S. PATENT DOCUMENTS

| | | | |
|---|---|---|---|
| 3,318,573 | 5/1967 | Matsuki et al. | 416/95 |
| 3,897,168 | 7/1975 | Amos | 415/115 |
| 4,332,133 | 6/1982 | Schwarz et al. | 415/116 |
| 4,582,467 | 4/1986 | Kisling | 415/115 |
| 4,869,640 | 9/1989 | Schwarz et al. | 415/115 |

FOREIGN PATENT DOCUMENTS

| | | | |
|---|---|---|---|
| 45457 | 4/1939 | United Kingdom | 415/914 |
| 45747 | 4/1939 | United Kingdom | 415/914 |
| 504214 | 4/1939 | United Kingdom | 415/914 |
| 877976 | 9/1961 | United Kingdom | 415/914 |

*Primary Examiner*—John T. Kwon

*Attorney, Agent, or Firm*—Jerome C. Squillaro

[57] ABSTRACT

A method and system for diverting leakage air back into the flow path of a turbine engine. A stator vane assembly is connected to a shroud assembly at the radially inner end of the stator vane assembly, the shroud assembly is provided with a scoop which is placed in the path of leakage air traversing in a forward direction from the high pressure static side of the stator vane to the low static pressure side of the stator vane. The leakage path is located between the stator vane assembly and a rotating member. The scoop intercepts the leakage air and re-directs the leakage air into an airflow path of the turbine engine with an aftward component of velocity.

8 Claims, 2 Drawing Sheets

FLOW DIVERTER FOR TURBOMACHINERY SEALS

BACKGROUND OF THE INVENTION

1. Field of the Invention

The present invention relates to turbomachinery and axial flow compressors. More particularly, the present invention pertains to a flow diverter or "scoop" which can be connected to the inner shroud region of a stator vane in an axial flow compressor of a gas turbine engine. The "scoop" comprises an annular foil which extends circumferentially around a rotor and is connected to the inner shroud region of a stator vane assembly in preselected stages of the compressor. The scoop intercepts leakage air flowing from the axially aft, high static pressure side of the stator vane assembly to the axially forward, low static pressure side of each stator vane assembly. The scoop re-directs this leakage air back into the working fluid flow such that a vector component of the re-directed air has an aftward velocity resulting in improved engine efficiency and stall margin.

2. Discussion of the Background

Gas turbine engines have been utilized to power a wide variety of vehicles and have found particular application in aircraft. The operation of a gas turbine engine can be summarized in a three step process in which air is compressed in a rotating compressor, heated in a combustion chamber, and expanded through a turbine. The power output of the turbine is utilized to drive the compressor and any mechanical load connected to the drive. Modern lightweight aircraft engines, in particular, have adopted the construction of an axial-flow compressor comprising a plurality of lightweight annular disk members carrying airfoils at the peripheries thereof. Some of the disk members are attached to an inner rotor and are therefore rotating (rotor) blade assemblies while other disk members depend from an outer casing and are therefore stationary (stator) blade or vane assemblies. The airfoils or blades act upon the fluid (air) entering the inlet of the compressor and raise its temperature and pressure preparatory to directing the air to a continuous flow combustion system. The stator vanes redirect and diffuse air exiting a rotating blade assembly into an optimal direction for a following rotating blade assembly. The air entering the inlet of the compressor is at a lower total pressure than the air at the discharge end of the compressor, the difference in total pressure being known as the compressor pressure ratio. Internally, a static pressure rise occurs across the stator vanes from diffusion and velocity reduction.

For a number of reasons having primarily to do with the design parameters of the cycle utilized in a particular engine, it is undesirable for the higher static pressure, higher static temperature air at the discharge side of a stator vane assembly to find its way back into the primary air flow at the inlet side of the stator vane assembly. This air, which returns to the relatively low static pressure area at the vane assembly inlet, is called leakage air and results in reduced engine efficiency. Particularly in the propulsion of aircraft, it is essential that the overall engine operate at a high efficiency level in order that the full advantages of the gas turbine engine may be realized. Leakage of air within the compressor thus detracts not only from the efficiency of the compressor itself but also the overall efficiency of engine operation.

Labyrinth seals connected radially inward from the stator vane assemblies of the compressor stage and connected to the inner rotor have long been utilized as a means to prevent leakage flow about the primary working fluid path around the stator vane assemblies. Notwithstanding the use of labyrinth seals, some leakage does occur, and this leakage air will travel, for example, from the high static pressure downstream side of a stator vane assembly to the lower static pressure at the upstream side of the stator vane assembly via a path which exists between the radial inward end of the stator vane assembly and the labyrinth seals connected to the rotor. After traveling to the upstream side of the stator vane assembly, the leakage air travels in a radially outward manner in the cavity existing between the stator vane assembly and adjacent rotor assembly. This radial path taken by the leakage air has a tendency to reduce the velocity and axial direction of air traversing the working fluid flow path of the compressor and tends to increase the amount of bleed air which further contributes to engine inefficiency.

Thus, a need is seen for a means for controlling leakage air flowing upstream and into the cavity existing between a stator vane and adjacent rotor blade and for preventing leakage air from impeding the forward momentum of air traversing the flow path of the compressor.

SUMMARY OF THE INVENTION

Accordingly, one object of the present invention is to provide a flow diverter or scoop which will control leakage air between a stator vane assembly and rotor blade assembly.

Another object of the present invention is to prevent leakage air from impeding primary air traversing the flow path of a compressor.

Another object of the present invention is to reduce the stress experienced by the upstream side of a stator vane as a result of exposure to higher static temperature air.

Yet another object of the present invention is to reduce the amount of bleed air.

Still another object of the present invention is to increase the efficiency of a gas turbine engine.

These and other valuable objects and advantages of the present invention are provided by a system and method for directing leakage airflow in a turbine engine back into a working fluid path, with the leakage airflow having an aftward component of velocity as it is directed back into the working fluid path. The system comprises a stator vane assembly which is secured to a stationary casing element, a rotor located radially inward from the stator vane assemblies, the rotor and stator vane assembly defining a leakage path leading from a higher static pressure region aft of the stator vane assembly to a lower static pressure region forward of the stator vane assembly. Diverter means are provided for directing the leakage airflow from the leakage airflow path in such a manner that the re-directed leakage airflow is given an aftward component of velocity, the diverter means being connected to a radially inward extreme of said stator vane assembly.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

When referring to the drawings, it should be understood that like reference numerals designate identical or corresponding parts throughout the respective figures.

DETAILED DESCRIPTION OF THE INVENTION

Figure 1:
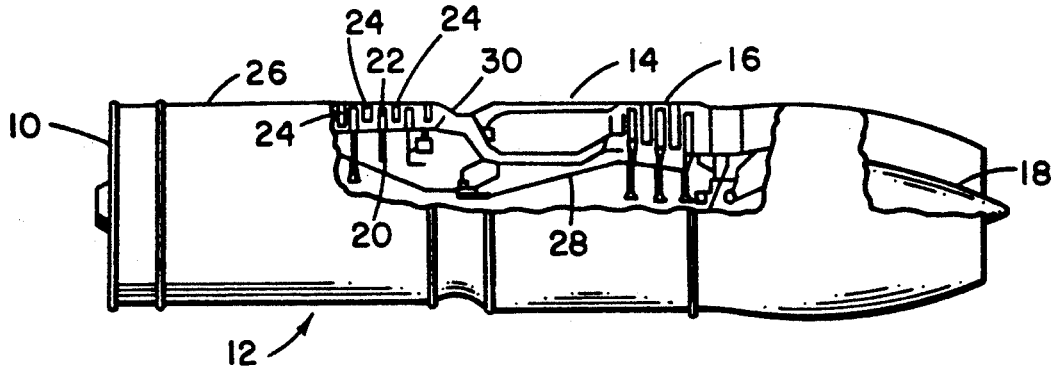
FIG. 1 (PRIOR ART)
FIG. 1 is a simplified schematic illustration of a prior art gas turbine engine.

FIG. 1 schematically demonstrates a prior art gas turbine engine 10. The engine 10 comprises a compressor 12, a combustor 14, a turbine 16, and a discharge nozzle 18. The compressor 12 includes a rotor 20 having a plurality of rotor blades 22 arranged in stages along its length and cooperating with stator vanes 24 extending inwardly from an outer casing 26, thereby forming an axial flow compressor for delivering pressurized air to support combustion in the combustor 14.

The hot gas stream thus generated drives the turbine 16 to derive power for rotating the compressor rotor 20 which is connected thereto by a hollow shaft 28. After passing through the turbine, the hot gas stream may be discharged through the nozzle 18 to provide a propulsive force which can be utilized for the operation of aircraft. The compressor outer casing 26 in combination with the rotor 20 defines an annular flow path leading to the combustor 14. This annular flow path beyond the compressor 12 is defined by an extension of the casing 26 and a diffuser 30 which is generally aligned with the rear end of the rotor 20.

Figure 2:
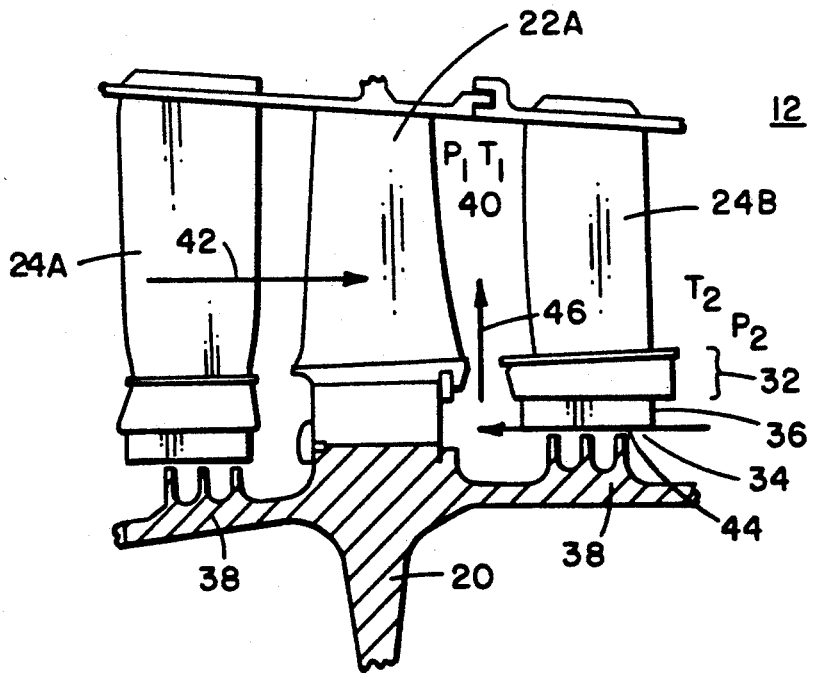
FIG. 2 (PRIOR ART)
FIG. 2 is a prior art schematic illustration depicting a rotor blade located between the two stator vanes in a compressor region of a gas turbine engine, arrows in the illustration indicate the flowstream and leakage paths.

FIG. 2 illustrates a segment of a conventional prior art turbine engine compressor 12 depicting rotor blade 22A which lies between stator vane assemblies 24A and 24B, respectively. Each stator vane assembly includes a radially inner shroud assembly 32. An annular seal assembly 36, which may comprise a honeycomb seal, is connected to a radially inner face of shroud assembly 32. A conventional labyrinth seal 38 extends radially outward from rotor 20 and forms an interface 34 with seal assembly 36.

Working fluid, e.g., air, compressed by rotating blade 22A enters space 40 between rotor blade 22A and stator vane 24B with a static air pressure of $P_1$ and a static temperature $T_1$. This air has a circumferential component and is desirably re-directed by stator vanes 24B into an optimal direction for impingement onto a succeeding rotating blade. To the aftward side of stator vane 24B, the air has a static air pressure of $P_2$ and a static temperature $T_2$. Air pressure $P_2$ is greater than air pressure $P_1$ and temperature $T_2$ is greater than temperature $T_1$. The greater air pressure $P_2$ and higher temperature $T_2$ can be appreciated by the fact that the air is re-directed and diffused to a lower velocity in airflow path 42 hence causing an increase in temperature and pressure as it moves aftward through the compressor.

The rotor 20 and associated seals 38 are rotating with respect to seal assembly 36. Typically, there is a clearance space between seals 38 and seal assembly 36 of a few thousandths of an inch. This clearance provides a leakage path for leakage air from the high pressure $P_2$ to the lower pressure $P_1$, as indicated by arrow 44. This leakage air rises vertically (radially outward), as indicated by arrow 46, and re-enters the working fluid stream, indicated by arrow 42, in a direction generally perpendicular to the working fluid flow direction. The resulting turbulence reduces compressor and engine efficiency. The significance of this leakage air flow can be appreciated from considering that as much as 0.5% of the total flow goes into leakage air.

Figure 3:
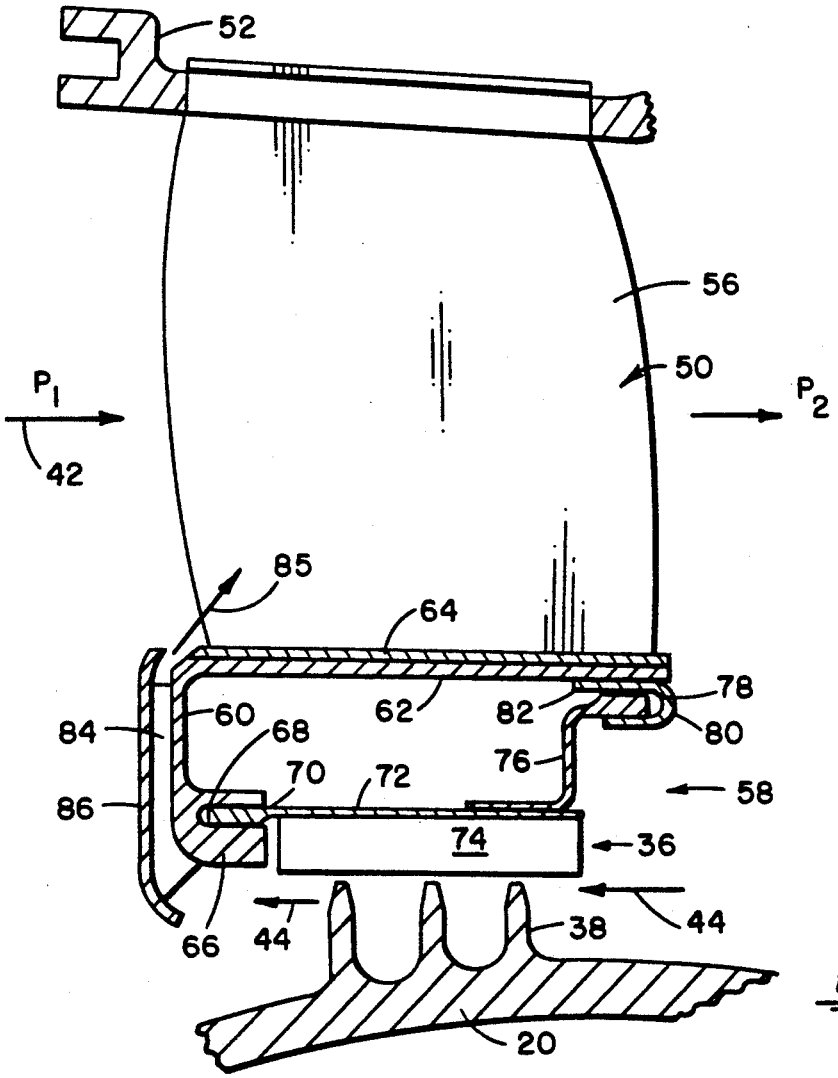
FIG. 3 is a side-view, cross-sectional schematic illustration of the flow diverter of the present invention attached to the shroud region of a stator vane.

With reference to FIG. 3, there is shown a stator vane assembly 50 in accordance with the teaching of the present invention positioned in a predetermined stage of a compressor in a gas turbine engine. The stator vane assembly 50 includes a radially outer vane liner 52 which is attached to an outer casing (not shown), an airfoil 56, and a radially inner shroud assembly 58. It will be appreciated that the vane liner 52 and shroud assembly 58 are annular members interconnected by a plurality of circumferentially spaced airfoils or vanes 56. The designator $P_2$ represents the higher static pressure, downstream or axially aft side of stator vane assembly 50 while the designator $P_1$ represents the lower static pressure, upstream or axially forward side of assembly 50. Working fluid or primary airflow is represented by arrow 42. The shroud assembly 58 is constructed as an annular box-like member having an axially forward U-shaped member 60 having a radially outer leg 62 extending parallel to an annular sheet member 64, the member 64 defining the radially inner boundary of the working fluid flow path. The radially inner leg 66 of member 60 includes an aftwardly open slot 68 for receiving one edge 70 of a backing plate 72 attached to honeycomb seal 74, the plate 72 and seal 74 forming the aforementioned seal assembly 36. An aft support 76 attached to plate 72 fits into a slot 78 in U-shaped member 80 to support the aft edge of seal assembly 36. The member 80 is also annular and has a radially outer leg 82 attached to an aft end of leg 62 of member 60. Mounting of seal assembly 36 using slots 68 and 78 allows for relative axial motion of seal assembly 36 with respect to vane assembly 50.

A plurality of circumferentially spaced ribs 84 extends axially forward of member 60 and an annular, arcuate shaped (in cross-section) flow diverter 86 is attached to the forwards ends of ribs 84. Each of the ribs 84 extends at an angle with respect to a radius of the engine to accommodate the generally circumferentially directed leakage air without creating turbulence between member 60 and diverter 86. As previously discussed, the leakage air, indicated by arrow 44, passes through the clearance space (typically about fifteen mils) between the labyrinth seal 38 and honeycomb seal assembly 36. The radially inner edge of diverter 86 extends inwardly of the leakage air path so that the forwardly flowing leakage air is captured by diverter 86. The arcuate cross-sectional shape of diverter 86 re-directs the leakage air radially outward in a generally curved pathway 85 so that air exiting the diverter pathway has a significant aft directed axially component. Although various methods may be used to manufacture the member 60 and flow diverter 86, a preferred method is to cast member 60 with the ribs 84 in situ and to braze the diverter 86 to the ribs 84.

Figure 4:
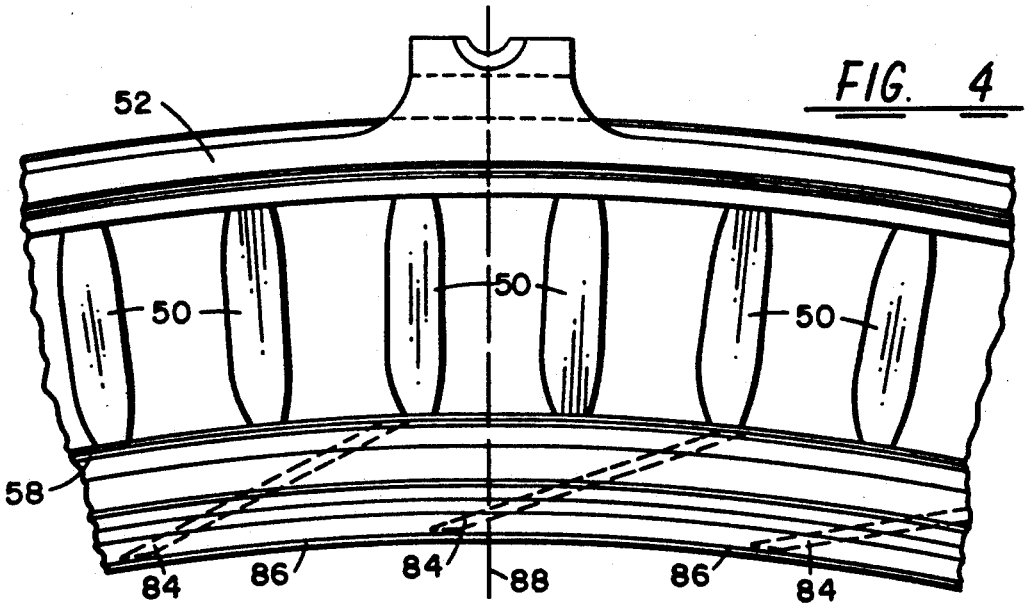
FIG. 4 is a forward directed axial view of a section of circumferentially arranged stator vanes with the flow diverter of the present invention being located radially inward form the stator vanes and extending circumferentially around the shroud region of a given stage of stator vanes.

Referring briefly to FIG. 4, there is shown an axial view of an annular array of stator vanes 50 extending between outer liner 52 and shroud assembly 58. This figure illustrates the angular orientation of ribs 84 with respect to engine radii 88.

Turning again to FIG. 3, the present invention provides a method and apparatus for re-incorporating leakage air, indicated by arrow 44, into the primary working fluid flow, indicated by arrow 42, in such a manner as to minimize turbulence in the working fluid flow during such re-introduction. The illustrative mechanism for achieving this desirable result is a flow diverter 86 attached in spaced apart relationship to an axially forward edge of a stator vane shroud assembly 32. The diverter 86 collects the leakage air and uses an arcuate cross-sectional shape to re-direct the air from a forward flow to a generally aft directed flow. The diverter 86 is attached using ribs 84 which are aligned so as to avoid turbulence of the leakage air passing through the diverter.

The foregoing detailed description of the preferred embodiment of the present invention is intended to be illustrative and non-limiting. Many changes and modifications are possible in light of the above teachings. Thus, it is understood that the invention may be practiced otherwise than as specifically described herein and still be within the scope of the appended claims.

What is claimed is:

1. A system for directing leakage air, flowing from a high static pressure side to a lower static pressure side of a stator vane located in a compressor of a turbine engine, back into a primary working fluid flow path of the compressor in such a manner that the re-directed leakage air enters the primary working fluid flow path with an aftward component of velocity, said system comprising:

a) a stator vane;

b) a vane liner connected to the radially outer extreme of said stator vane;

c) a shroud member connected to the radially inner extreme of said stator vane;

d) a stationary seal assembly connected to the radially inner extreme of said shroud member;

e) a rotatable sealing means located radially inward from said stationary seal assembly, a leakage flow path being formed at the interface between said rotatable sealing means and said seal assembly; and f) a flow diverter connected to a leading edge of said shroud member and having a channel for capturing the leakage air which exits the rotatable sealing means and for directing the leakage air back into the primary working fluid flow path with an aftward component of velocity, said channel in direct fluid communication with said primary working fluid flow path.

2. A system for re-directing leakage airflow in a gas turbine engine into a primary airflow path, the leakage airflow having an aftward component of velocity as it is re-directed into the primary airflow path, said system comprising:

a) a stator vane assembly including a plurality of circumferentially spaced stator vanes secured to a stationary casing element of the engine;

b) a rotor means located radially inward from said stator vane assembly, the rotor means and stator vane assembly defining a leakage airflow path leading from a higher static pressure cavity located to the aft of said stator vane assembly to a lower static pressure cavity located forward of the stator vane assembly; and c) means for directing the leakage airflow from the leakage airflow path back into the primary airflow path in such a manner that the re-directed leakage airflow is given an aftward component of velocity; and d) wherein the means for directing comprises a flow diverter having a radially inner edge extending inwardly of the leakage airflow path thereby capturing the leakage airflow exiting a sealing means formed by said stator vane assembly and said rotor means, said flow diverter being coupled to a leading edge of a radially inner end of said stator vane assembly and including an arcuate cross-section for re-directing the forwardly flowing leakage flow air into an aft direction.

3. A system according to claim 2, wherein said flow diverter includes a radially outer edge positioned adjacent the primary airflow path.

4. A system for re-directing leakage airflow in a gas turbine engine into an airflow path, the leakage airflow having an aftward component of velocity as it is re-directed into the airflow path, said system comprising:

a) a stator vane assembly including a plurality of circumferentially spaced stator vanes secured to a stationary casing element of the engine;

b) a rotor means located radially inward from said stator vane assembly, the rotor means and stator vane assembly defining a leakage airflow path leading from a higher static pressure cavity located to the aft of said stator vane assembly to a lower static pressure cavity located forward of the stator vane assembly; and c) means for directing the leakage airflow from the leakage airflow path back into the airflow path in such a manner that the re-directed leakage airflow is given an aftward component of velocity;

d) wherein the means for directing comprises a flow diverter coupled to a radially inner end of said stator vane assembly and being on an axially forward surface for re-directing the forwardly flowing leakage flow air into an aft direction;

e) wherein said stator vane assembly comprises:

i) a shroud attachment connected to a shroud member at the radially inner extreme of said stator vane;

ii) a C-shaped member connected to said shroud attachment;

iii) an aftward member forming an aftward boundary of said shroud attachment and connecting to said C-shaped member; and iv) a radially inward member connected to said aftward member, said radially inward member being substantially parallel to said shroud attachment, said radially inward member being connected to an aftward portion of said flow diverter.

5. A system for re-directing leakage airflow in a gas turbine engine into an airflow path, the leakage airflow having an aftward component of velocity as it is re-directed into the airflow path, said system comprising:

(a) a stator vane assembly including a plurality of circumferentially spaced stator vanes secured to a stationary casing element of the engine;

(b) a rotor means located radially inward from said stator vane assembly, the rotor means and stator vane assembly defining a leakage airflow path leading from a higher static pressure cavity located to the aft of said stator vane assembly to a lower static pressure cavity located forward of the stator vane assembly; and (c) means for directing the leakage airflow from the leakage airflow path back into the airflow path in such a manner that the re-directed leakage airflow is given an aftward component of velocity;

d) wherein the means for directing comprises a flow diverter coupled to a radially inner end of said stator vane assembly and being on an axially forward surface for re-directing the forwardly flowing leakage flow air into an aft direction; and e) wherein said flow diverter comprises an annular foil having an arcuately shaped cross-section and being coupled to a leading edge of the radially inner end of the stator vane assembly, said foil being positioned with an aft directed concave surface extending radially inward into a leakage flow path radially inward of said stator vane assembly, a radially outer edge of said annular foil terminating approximately co-extensively with a radially inner end of said stator vanes of said stator vane assembly.

6. The system of claim 5 wherein said flow diverter is coupled to said stator vane assembly by a plurality of circumferentially spaced ribs extending axially forward of said stator vane assembly, each of said ribs being angularly oriented with respect to a radius line of the engine such that air re-directed by said flow diverter and having a component of circumferential motion is not subject to turbulence within said flow diverter.

7. A method for improving efficiency of a gas turbine engine by control of leakage airflow, the leakage airflow flowing from a high static pressure side located to the aft of a stator vane assembly in the engine to a lower static pressure side located to the front of the stator vane assembly, the stator vane assembly being located radially outward of a rotating member and a leakage airflow path being defined between the rotating member and the stator vane assembly, the turbine engine including a flow diverter coupled to a leading edge of the stator vane assembly, said flow diverting having a radially inner edge, the turbine engine having a primary airflow path which flows in an aftward direction, said method comprising the steps of:

a) positioning the radially inner edge of the flow diverter radially inward of the leakage air path on the lower static pressure side of the stator vane assembly;

b) intercepting the leakage air flowing from the higher static pressure side to the lower static pressure side of the stator vane assembly, wherein said step of intercepting is accomplished with the flow diverter; and c) re-directing the intercepted leakage air into the primary airflow path with a generally aftward direction of flow.

8. A method according to claim 7, wherein the flow diverter includes an arcuate cross-sectional shape and is positioned with an aft directed concave surface facing the forwardly flowing leakage air, wherein the step of re-directing is accomplished with the arcuate cross-sectional shape.

* * * * *

UNITED STATES PATENT AND TRADEMARK OFFICE

CERTIFICATE OF CORRECTION

PATENT NO. : 5,211,533

DATED : May 18, 1993

INVENTOR(S) : Roger C. Walker et al.

It is certified that error appears in the above-identified patent and that said Letters Patent is hereby corrected as shown below:

Title page, Inventor line, add (item 75)

--Harold P. Rieck, Jr.
Ronald D. Zerkle
Michael A. Sullivan
Richard W. Albrecht--

Signed and Sealed this

First Day of February, 1994

Bruce Lehman

*Attest:*

BRUCE LEHMAN

*Attesting Officer*

*Commissioner of Patents and Trademarks*